United States Patent [19]

Jes

[11] 4,353,495

[45] Oct. 12, 1982

[54] ASPARAGUS CARTON

[75] Inventor: Otto J. Jes, Long Beach, Calif.

[73] Assignee: Willamette Industries, Inc., Portland, Oreg.

[21] Appl. No.: 264,762

[22] Filed: May 18, 1981

[51] Int. Cl.[3] ..... B65D 5/00; B65D 5/56; B65D 25/00

[52] U.S. Cl. ..... 229/16 R; 229/6 A; 229/33; 229/44 R

[58] Field of Search ..... 229/6 A, 16 R, 16 A, 229/16 C, 22, 32, 33, 35, 44 R, 30, 6 R; 204/44

[56] References Cited

U.S. PATENT DOCUMENTS 4,313,547 2/1982 Osborne ..... 229/33

FOREIGN PATENT DOCUMENTS 2382375 11/1978 France ..... 229/44 R

*Primary Examiner*—Herbert F. Ross
*Attorney, Agent, or Firm*—Eugene D. Farley

[57] ABSTRACT

A carton for packing and shipping asparagus is constructed from a single sheet of carton stock and includes a bottom, four side walls and a top in a substantially rectangular configuration. Inside the carton and adjacent one of the sidewalls is a partition reaching substantially from the bottom corner to the top of the carton. The partition slopes inwardly to provide an enlarged bottom area designed to accommodate the base portion of the asparagus stalks, and a restricted top area designed to support and protect the fragile top portion thereof.

8 Claims, 8 Drawing Figures

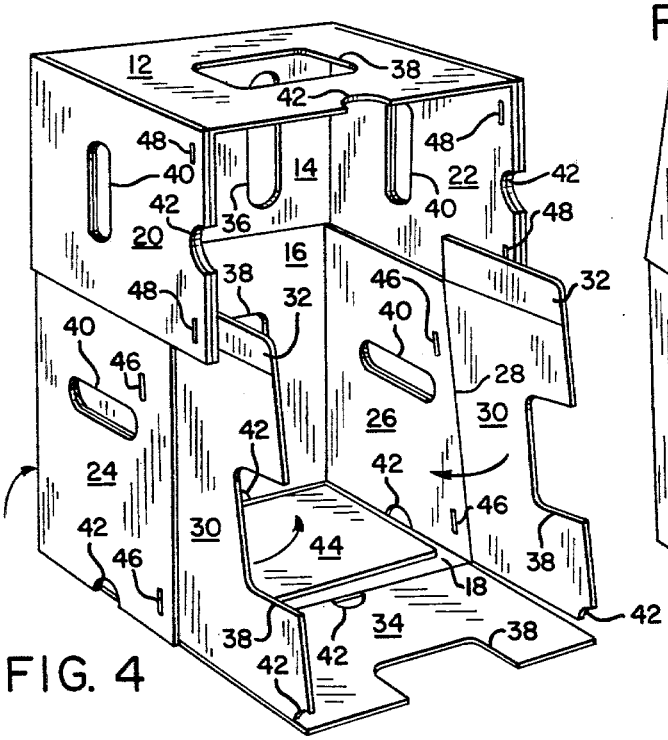
FIG. 4
FIG. 5
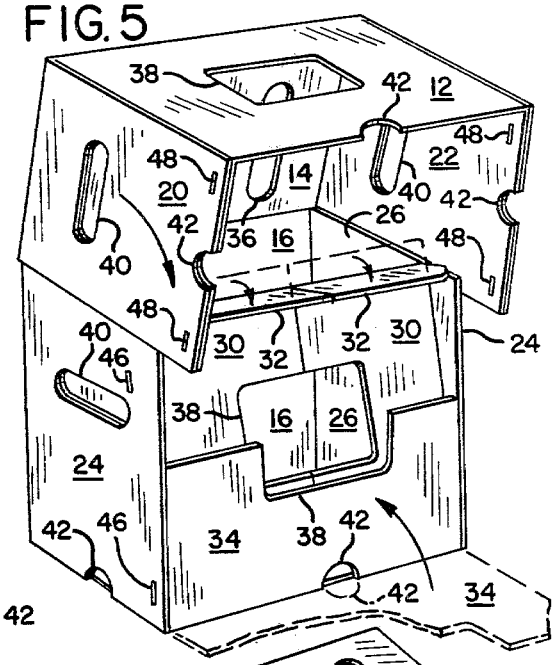
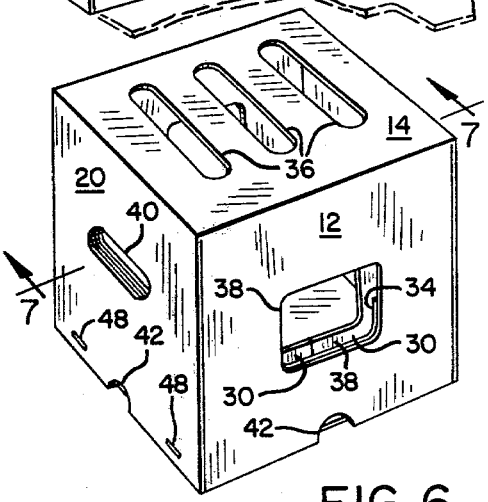
FIG. 6
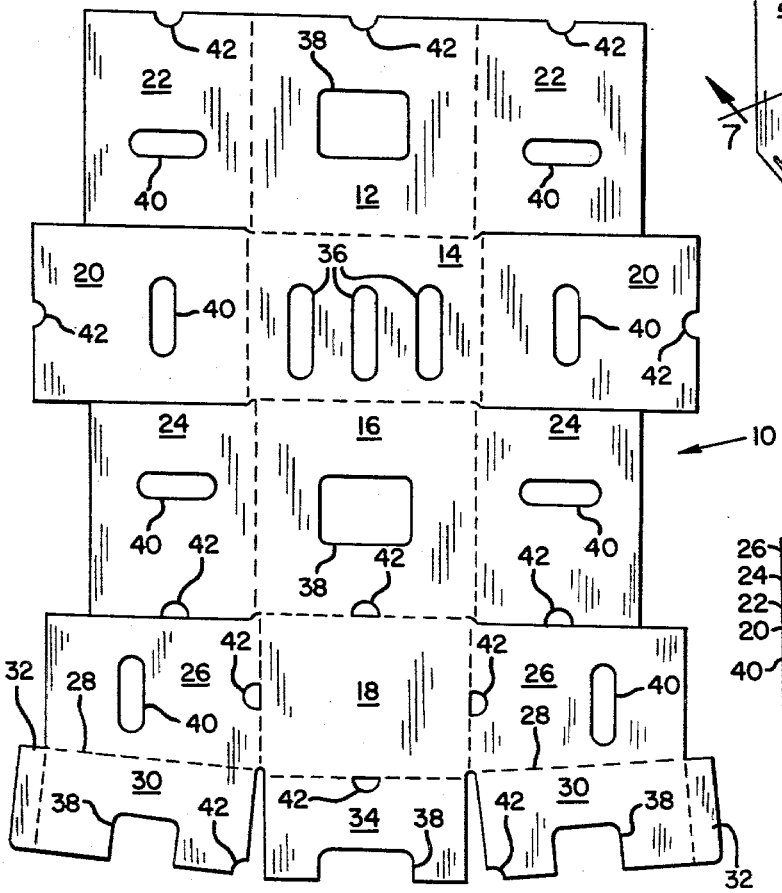
FIG. 8
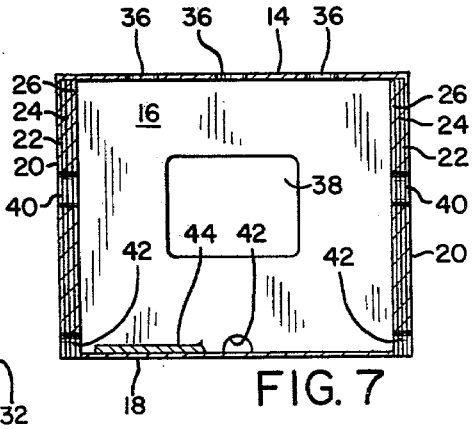
FIG. 7

ASPARAGUS CARTON

This invention relates to corrugated cartons, and more particularly to a carton for packing asparagus and including a slanted internal partition to vary the cross sectional area of the interior of the carton from top to bottom, while maintaining a substantially rectangular exterior.

Asparagus is a fast-growing shoot or spear that is harvested while still in its active growth cycle. The vegetable is tapered in shape and has a tender tip end which breaks easily. During transportation and storage, it is necessary to protect the tender tips from breakage. It also is necessary to keep the stalks cool and moist so that they will not be limp when they reach the market place. If kept moist, asparagus will continue to grow after it has been harvested.

Generally, asparagus has been packed upstanding in tapered crates made of wood or plastic. These crates require a rigid construction and are expensive and bulky. They also present a storage problem at the packing site, and a disposal problem at the consumer site.

Accordingly, it is the general object of the present invention to provide a carton for asparagus made from a single sheet of carton stock and having a rectangular exterior shape and a sloping internal partition to support the length of the asparagus stalks.

Another object is to provide a carton which is easy to pack without damaging the asparagus stalks, and which protects the stalks during transportation and storage.

Another object is to provide a carton of increased stacking strength having multi-thickness sidewalls.

A further object is to provide a carton having a plurality of holes for rapid cooling and drainage of the asparagus.

A still further object is to provide a wax-dipped carton to maintain carton rigidity in a wet environment.

Other objects and advantages and the manner in which they are achieved will be made apparent in the following specification and claims.

SUMMARY OF THE INVENTION

In its basic concept, the presently described carton for packing and shipping asparagus is constructed from a single sheet of carton stock and includes a bottom, four side walls and a top in a substantially rectangular configuration. Inside the carton and adjacent one of the sidewalls is a partition reaching substantially from the bottom corner to the top of the carton. The partition slopes inwardly to provide an enlarged bottom area designed to accommodate the base portion of the asparagus stalks, and a restricted top area designed to support and protect the fragile top portion thereof.

BRIEF DESCRIPTION OF THE DRAWINGS

FIGS. 2–5 are views similar to FIG. 1, illustrating sequential steps in assembling the carton.

FIG. 6 is a top perspective view of the assembled carton.

FIG. 7 is a section taken along the line 7—7 of FIG. 6.

FIG. 8 is a plan view of the blank from which the asparagus carton is constructed.

DESCRIPTION OF THE PREFERRED EMBODIMENT

Figure 1:
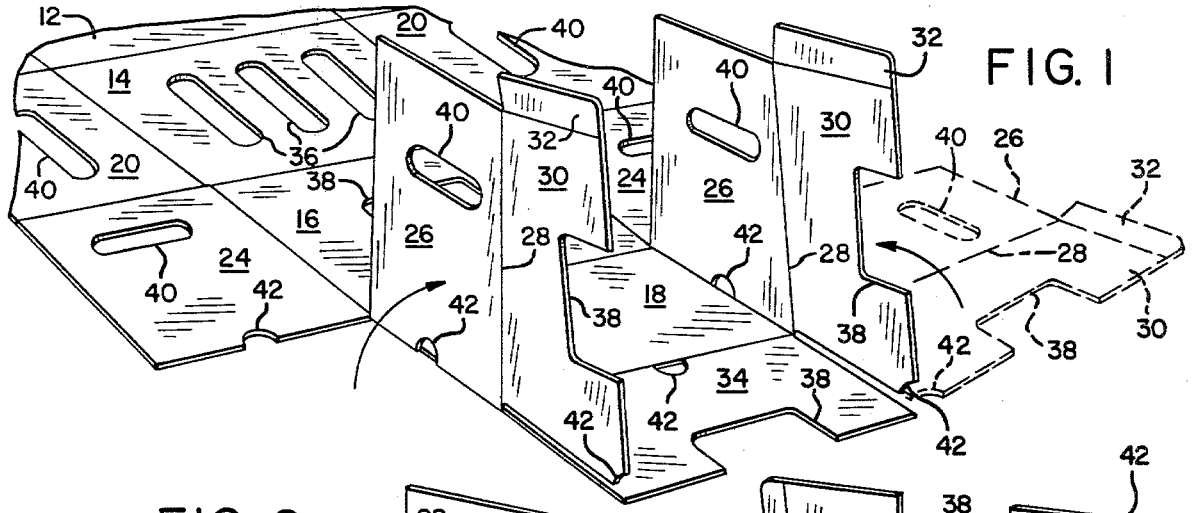
FIG. 1 is a top perspective view of the asparagus carton of the present invention illustrating the first step in assembling the carton.

As shown in FIG. 8 the asparagus carton of the present invention is constructed from a single sheet of carton stock cut and scored into a blank 10. In the plan drawing, solid lines indicate cuts and dashed lines indicate hinge lines.

A front sidewall 12 is hinged to a top panel 14. The top panel is in turn hinged to a rear sidewall 16. The rear sidewall is in turn hinged to a bottom panel 18.

To each of the panels indicated as front 12, top 14, rear 16 and bottom 18 is hinged a pair of sidewall panels. Outer sidewall panels 20 are hinged to the top panel. To the front sidewall and the rear sidewall are attached intermediate or second and third sidewall panels 22 and 24, respectively. To the bottom panel are attached inner sidewall panels 26.

It should be noted that all of the outer and intermediate panels are substantially rectangular in shape, and thus when folded produce a carton having a substantially rectangular exterior. However inner sidewall panels 26 are trapezoidal in configuration, and include a slanted hinge line 28.

To inner sidewall panels 26 are hinged partition panels 30. Since they are attached on slanted hinge line 28 they slope inwardly when folded.

Attached to the top edge of partition panels 30 are spacers 32 which fold back into the top corner of the carton and maintain the partition spaced apart from front sidewall 12.

Also, to bottom panel 18 is attached a front flap 34 to be folded up adjacent to front sidewall 12 and partitions 30.

Although it is preferable that partition panels 30 each be of a width to be folded to cover substantially half of the front of the carton, it should be noted that one panel could extend the entire distance across the carton, or there could be overlap. Also, it should be noted that flap 34 could cover the entire front of the carton, rather than be truncated as is illustrated. These variations and other obvious variations fall within the spirit and scope of the invention.

In the panels are provided a plurality of holes or cutouts such as is illustrated at 36, 38, 40 and 42. Top holes 36 and front and back holes 38 provide for fluid to enter into the carton and circulate around the asparagus for rapid cooling thereof. Handholes 40 in the inner, intermediate and outer sidewalls align to provide an easy means of grasping and carrying the carton, as well as provide further ventilation. Drainage holes 42 are adjacent the bottom of the carton and provide for drainage of fluid from the carton.

As shown best in FIG. 7, two of the opposed sidewalls are multi-thickness. This is to provide increased stacking strength.

Also, the carton is preferably wax-dipped to repel water and thus maintain its rigidity in a wet environment.

A moist pad 44 is provided to keep the base ends of the stalks of asparagus moist at all times to prevent the asparagus stalks from wilting.

OPERATION

As shown in FIG. 1, to assemble the asparagus carton of the present invention inner sidewall panels 26 are first folded up perpendicular to bottom 18 as shown by the arrows.

Figure 2:
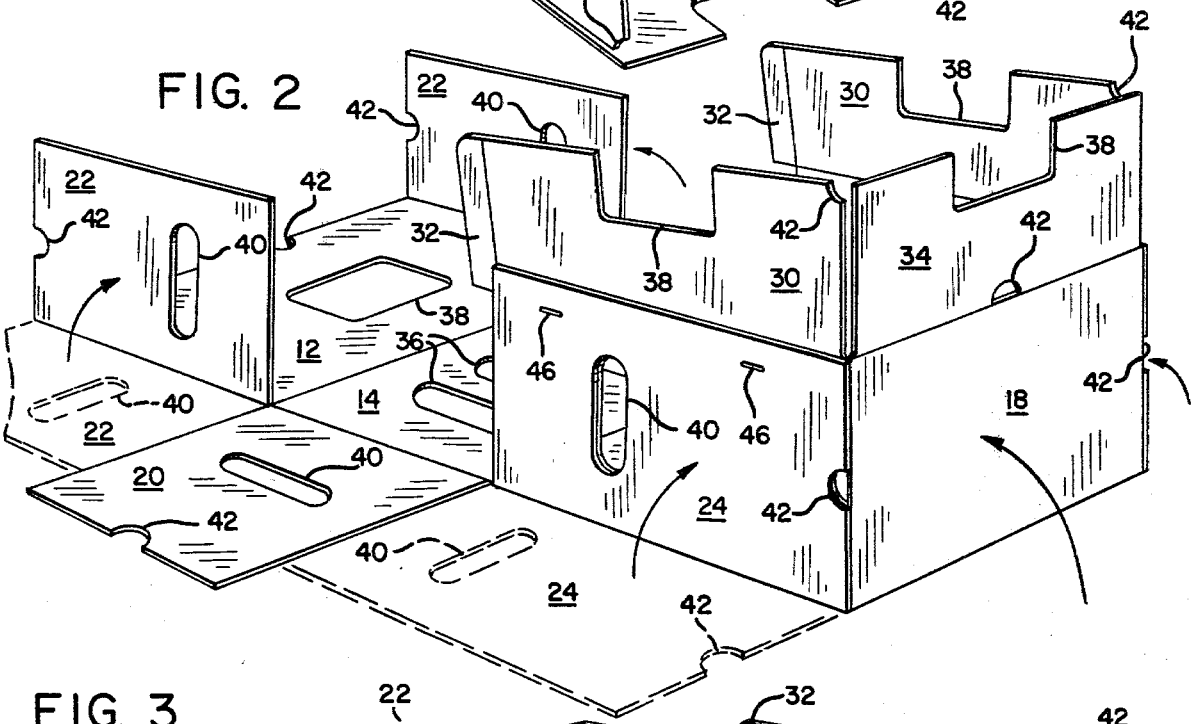

Next, as shown in FIG. 2, bottom 18 is folded up perpendicular to rear sidewall 16. This action places the edge of inner sidewall panels 26 adjacent the hinge line between the rear sidewall panel and third intermediate sidewall panel 24. Then, as shown by the arrows, the third sidewall panel is folded up adjacent to the inner sidewall panel. Panels 24 and 26 are then fastened together by glue, stitching or staples as illustrated at 46.

Then second intermediate sidewall panels 22 are folded up perpendicular to front 10 as illustrated by the arrows.

Figure 3:
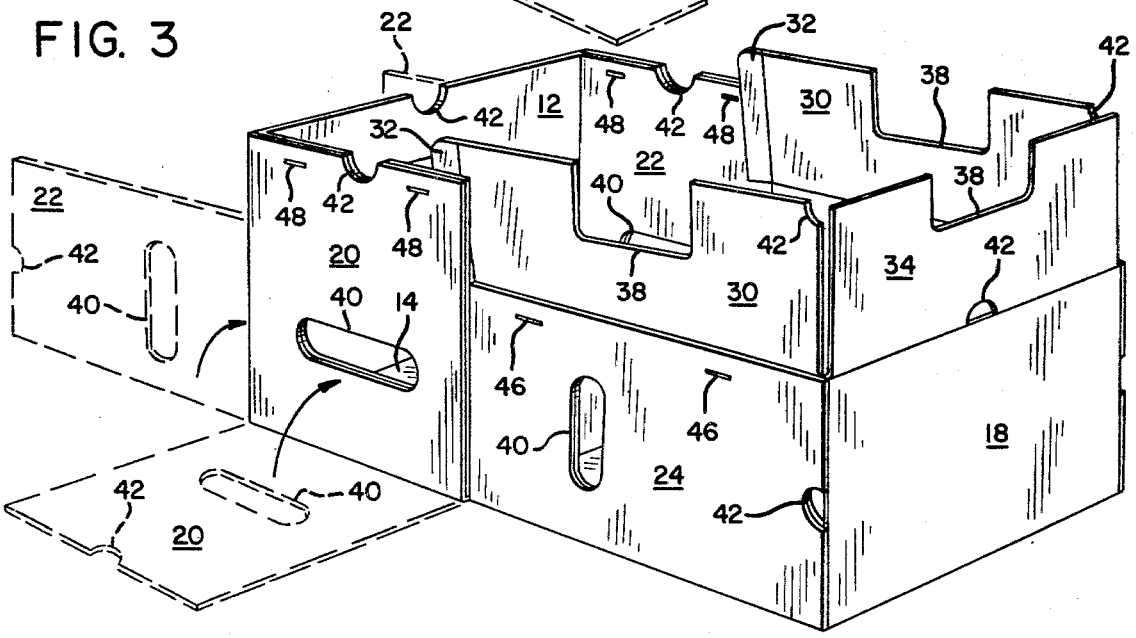

Next, as shown in FIG. 3, front sidewall panel 12 is folded up perpendicular to top panel 14. This action places the edge of the second intermediate sidewall panel 22 adjacent the hinge line between the top panel and outer sidewall panel 20. The outer sidewall panel is then folded up adjacent panel 22 as shown by the arrows and fastened by staples 48 or the like.

Then, as shown in FIG. 4, the entire assembly is tipped up on its bottom 18. Moist pad 44 is placed in the bottom of the carton. The carton is then ready to be filled with asparagus. It is easily loaded, the top and front both being open so that the interior of the carton is easily accessible. It is important that the asparagus be handled gently to avoid damage to its fragile top portion.

After the carton is filled, partition panels 30 are closed like doors on the packed asparagus, as illustrated by the arrows.

Then, as shown in FIG. 5, front flap 34 is folded up adjacent partition panels 30. Spacers 32 are folded back towards the top corner of the box. Then the box top and front are folded down to complete the packing and assembly.

The finished carton is illustrated in FIG. 6. It is evident that the carton of the present design is of high strength. FIG. 7 also illustrates the multi-thickness sidewalls which provide stacking strength.

The asparagus in the carton is held securely. The entire length of the tapered stalks are supported by virtue of the slanted partition. The partition itself is secured both by the right angle hinge with the inner sidewall panel and by the spacer supporting the top of the partition spaced apart from the top corner of the carton.

The exterior of the carton is rectangularly shaped and this allows the cartons to be stacked one upon the other. There is no drooping of the bottom edges of the carton since the carton below has a top of the same dimension.

The multiplicity of holes in the carton allow circulation of cooling fluids since it is important to cool the asparagus rapidly. The carton retains its rigidity by virtue of its water proof covering.

It can be seen that a carton for packing and shipping asparagus has been provided which achieves the objects of the invention. Obvious modifications may be made to the structure without departing from the intended spirit and scope of the invention.

Having described my invention in its preferred embodiment, I claim:

1. A substantially rectangular asparagus carton made from a single sheet of carton stock and comprising:

(a) a bottom, four sidewalls and a top;

(b) an inner sidewall having a trapezoidal configuration and including an edge slanted from the bottom corner of the carton to the top thereof at a point spaced apart from the adjoining sidewall; and (c) an inner partition hinged to the slanted edge of the trapezoidal sidewall and reaching substantially from the bottom corner to the top of the carton, the partition sloping inwardly to provide an enlarged bottom area designed to accommodate the base portion of the asparagus stalks, and a restricted top area designed to support and protect the fragile top portion thereof.

2. The asparagus carton of claim 1 further comprising a second inner sidewall on the opposite side of the carton from the first inner sidewall and having a similar trapezoidal configuration, and wherein the partition is in sections, one section being hinged to one inner sidewall and the other section being hinged to the opposite inner sidewall, the sections being folded in to substantially span the area between the sidewalls.

3. The asparagus carton of claim 1 further comprising a spacer hinged to the top of the partition and extending to the top corner of the carton to maintain the top of the partition spaced apart from its adjacent sidewall.

4. The asparagus carton of claim 1 wherein the sidewalls have a plurality of holes therein to provide for rapid cooling of the asparagus.

5. The asparagus carton of claim 1 wherein at least two of the sidewalls are multi-thickness to increase stacking strength.

6. The asparagus carton of claim 1 wherein the sidewalls have drainage holes therein adjacent the bottom of the carton.

7. The asparagus carton of claim 1 wherein the carton is wax-dipped.

8. The asparagus carton of claim 1 further comprising a flap hinged to the bottom and folded up adjacent to the sidewall and partition.

* * * * *